US005967751A

United States Patent [19]

Chen

[11] Patent Number: 5,967,751

[45] Date of Patent: Oct. 19, 1999

[54] PROPELLER ASSEMBLY FOR MARINE ENGINE

[76] Inventor: Fu Daul Chen, 4F., No. 3, Avenue 17, Lane 300, Sec. 4, Jen Ai Road, Taipei, Taiwan

[21] Appl. No.: 08/931,195

[22] Filed: Sep. 16, 1997

[51] Int. Cl.[6] ..... B63H 1/20

[52] U.S. Cl. ..... 416/93 A; 416/134 R; 416/245 A; 464/182; 440/83

[58] Field of Search ..... 416/93 A, 204 R, 416/134 R, 244 R, 245 A; 464/89, 182; 440/49, 83; 463/375, 359

[56] References Cited

U.S. PATENT DOCUMENTS

| | | | |
|---|---|---|---|
| 2,471,982 | 5/1949 | Shulda | 403/359 |
| 2,974,502 | 3/1961 | Radcliff | 416/134 R |
| 3,045,763 | 7/1962 | Perrott | 416/134 R |
| 4,778,419 | 10/1988 | Bolle et al. | 416/134 R |
| 4,911,663 | 3/1990 | Meier | 416/93 A |
| 5,201,679 | 4/1993 | Velte, Jr. et al. | 416/134 R |
| 5,252,028 | 10/1993 | LoBosco et al. | 416/93 |

*Primary Examiner*—Edward K. Look
*Assistant Examiner*—Richard Woo
*Attorney, Agent, or Firm*—Jansson, Shupe, Bridge & Munger, Ltd.

[57] ABSTRACT

A propeller device includes a shaft rotatably supported in a marine engine, and a hub secured to the shaft and having three or more axially extending keys. A propeller housing includes three or more pairs of lobes for forming keyways and for engaging with the keys of the hub. The keyways include a narrower outer end for preventing the housing from disengaging from the hub. Three or more stops are disposed between the pairs of lobes. A retainer disc includes a number of angularly spaced ears for engaging with the lobes and the stops and for preventing the propeller housing from being disengaged from the propeller shaft.

16 Claims, 3 Drawing Sheets

PROPELLER ASSEMBLY FOR MARINE ENGINE

BACKGROUND OF THE INVENTION

1. Field of the Invention

The present invention relates to a propeller assembly, and more particularly to a propeller assembly for a marine engine.

2. Description of the Prior Art

A typical marine propeller assembly is disclosed in U.S. Pat. No. 5,252,028 to LoBosco et al. and comprises a propeller housing to be secured to a propeller shaft and to be rotated by the propeller shaft. However, the retainer disc may not solidly secure the propeller housing in place such that the propeller housing may be disengaged from the propeller shaft inadvertently and such that the marine propeller assembly may easily become failure.

The present invention has arisen to mitigate and/or obviate the afore-described disadvantages of the conventional marine propeller assemblies.

SUMMARY OF THE INVENTION

The primary objective of the present invention is to provide a propeller assembly which may be solidly secured to the propeller shaft and which may be prevented from being disengaged from the propeller shaft inadvertently.

In accordance with one aspect of the invention, there is provided a propeller assembly for a marine engine, the propeller assembly comprises a propeller shaft rotatably supported in the marine engine and including an externally splined portion and an externally threaded outer end portion, a locking nut for engaging with the externally threaded outer end portion of the propeller shaft, a hub including at least three angularly spaced and axially extending keys each having a narrower outer end and a wider inner end, a central tube secured in the hub and rotated in concert with the hub, the central tube including a splined inner bore for receiving and mating with the externally splined portion of the propeller shaft and for allowing the hub to be rotated in concert with the propeller shaft, a tubular propeller housing including at least three angularly spaced outer propeller blades and including an inner peripheral surface having at least three pairs of lobes extended radially inward from the inner peripheral surface for forming and defining at least three keyways and for engaging with the keys of the hub, the lobes each including an outer end, the keyways each including a narrower outer end for engaging with the narrower outer end of the key and each including a wider inner end for engaging with the wider inner end of the key and for preventing the keys from being disengaged from the tubular propeller housing, the tubular propeller housing including at least three stops extended radially inward from the inner peripheral surface of the tubular propeller housing, the stops each including an outer end flush with the outer ends of the lobes, a retainer disc including a splined bore for engaging with and for mating with the externally splined portion of the propeller shaft, the retainer disc including a plurality of angularly spaced ears for engaging with the outer ends of the lobes and for engaging with the outer ends of the stops and for preventing the lobes and the stops from passing the ears of the retainer disc and for preventing the propeller housing from being disengaged from the propeller shaft, and a washer engaged between the retainer disc and the locking nut for preventing the locking nut from being rotated by the tubular propeller housing.

The stops include a number equals to that of the ears, a distance between any two adjacent stops is greater than a distance between any two adjacent ears for preventing the stops from moving beyond the ears and for preventing the tubular propeller housing from being disengaged from the retainer disc.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
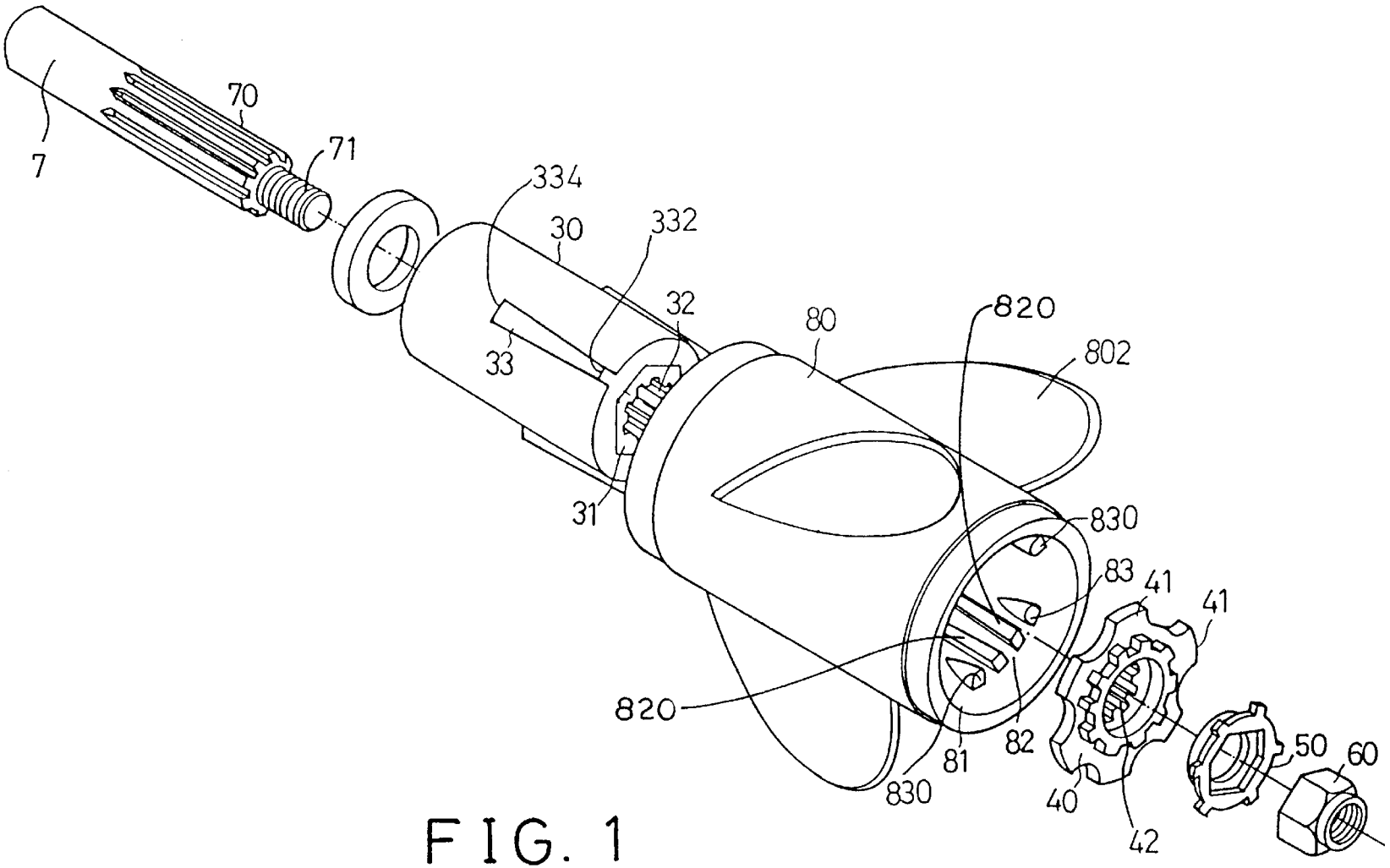
FIG. 1 is an exploded view of a propeller assembly in accordance with the present invention.
Figure 2:
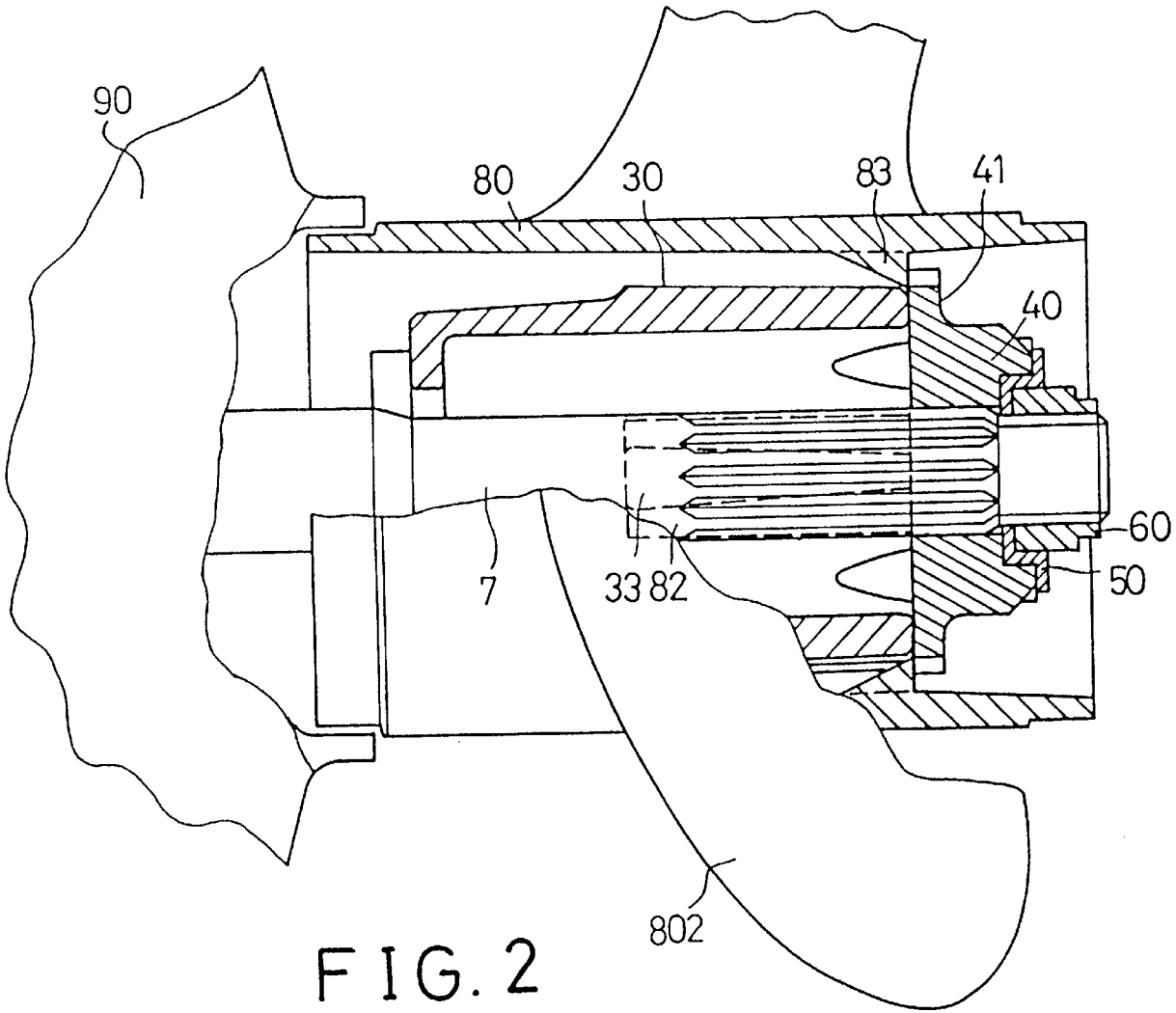
FIG. 2 is a partial side view of the propeller assembly, in which a portion of the propeller housing is cut off for showing the interior structure of the propeller assembly.

Referring to the drawings, and initially to FIGS. 1 and 2, a propeller assembly in accordance with the present invention is provided for a marine engine 90 and comprises a rotatable propeller shaft 7 rotatably supported in the marine engine 90. The propeller shaft 7 includes an externally splined portion 70 and includes an externally threaded outer end portion 71 for engaging with a locking nut 60. A hub 30 includes three or more angularly spaced and axially extending keys 33 each having a narrower outer end 332 and a wider inner end 334. A central tube 31 is engaged in the hub 30 and includes a non-circular or hexagonal outer peripheral surface for engaging with a hexagonal bore of the hub 30 and for allowing the central tube 31 to be rotated in concert with the hub 30. The central tube 31 includes a splined inner bore 32 for receiving and mating with the externally splined portion 70 of the propeller shaft 7 and for allowing the hub 30 to be rotated in concert with the propeller shaft 7.

A tubular propeller housing 80 includes three or more angularly spaced propeller blades 802 and includes three or more pairs of lobes 820 extended radially inward from the inner peripheral surface 81 of the tubular propeller housing 80 for forming and defining three or more keyways 82 which are provided for engaging with the keys 33 of the hub 30. The keyways 82 each includes a narrower outer end for engaging with the narrower outer end 332 of the key 33 and each includes a wider inner end for engaging with the wider inner end 334 of the key 33 such that the keys 33 may be prevented from being disengaged from the tubular propeller housing 80. Three or more stops 83 are disposed between the pairs of lobes 820 and include an outer end 830 flush with the outer ends of the lobes 820.

A retainer disc 40 includes a number of angularly spaced ears 41 for engaging with the outer ends of the lobes 820 and for engaging with the outer ends 830 of the stops 83 and for preventing the lobes 820 and the stops 83 from passing the ears 41 of the retainer disc 40. The retainer disc 40 includes a splined bore 42 for engaging with and for mating with the externally splined portion 70 of the propeller shaft 7. A spoked washer 50 is engaged between the retainer disc 40 and the locking nut 60 for preventing the locking nut 60 from being rotated by the tubular propeller housing 80.

Figure 3:
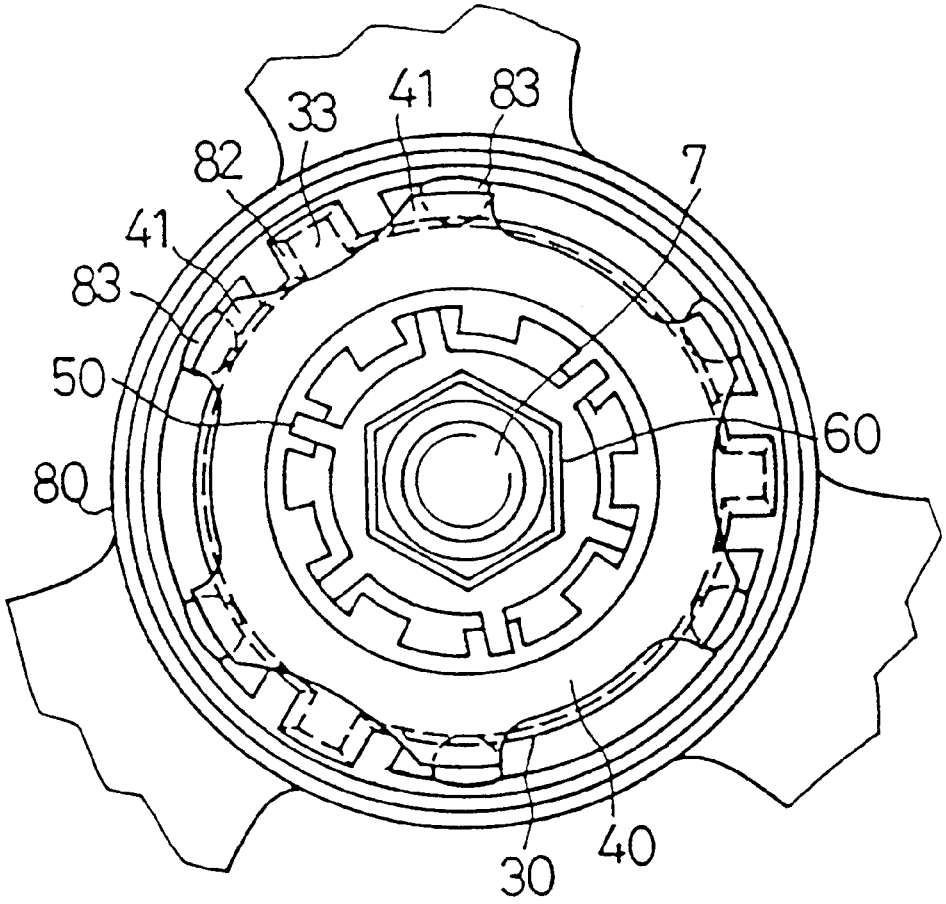
FIG. 3 is an end view of the propeller assembly illustrating the operation of the propeller assembly.

It is to be noted that, as shown in FIG. 3, the number of the stops 83 are preferably equals to that of the ears 41 and are provided for engaging with the ears 41. The distance between any two adjacent stops 83 is greater than the distance between any two adjacent ears 41 for preventing the stops 83 from moving beyond the ears 41 and for preventing the tubular propeller housing 80 from being disengaged from the retainer disc 40, such that the tubular propeller housing 80 may be safely and solidly retained in place.

Accordingly, the propeller assembly in accordance with the present invention may be solidly secured to the propeller shaft and may be prevented from being disengaged from the propeller shaft inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A propeller assembly for a marine engine, said propeller assembly comprising:

a propeller shaft rotatably supported in the marine engine and including an externally splined portion and an externally threaded outer end portion, a locking nut for engaging with said externally threaded outer end portion of said propeller shaft, a hub including at least three angularly spaced and axially extending keys each having a narrower outer end and a wider inner end, a central tube secured in said hub and rotated in concert with said hub, said central tube including a splined inner bore for receiving and mating with said externally splined portion of said propeller shaft and for allowing said hub to be rotated in concert with said propeller shaft, a tubular propeller housing including at least three angularly spaced outer propeller blades and including an inner peripheral surface having at least three pairs of lobes extended radially inward from said inner peripheral surface for forming and defining at least three keyways and for engaging with said keys of said hub, said lobes each including an outer end, said keyways each including a narrower outer end for engaging with said narrower outer end of said key and each including a wider inner end for engaging with said wider inner end of said key and for preventing said keys from being disengaged from said tubular propeller housing, said tubular propeller housing including at least three stops extended radially inward from said inner peripheral surface of said tubular propeller housing, said stops each including an outer end flush with said outer ends of said lobes, a retainer disc including a splined bore for engaging with and for mating with said externally splined portion of said propeller shaft, said retainer disc including a plurality of angularly spaced ears for engaging with said outer ends of said lobes and for engaging with said outer ends of said stops and for preventing said lobes and said stops from passing said ears of said retainer disc and for preventing said propeller housing from being disengaged from said propeller shaft, and a washer engaged between said retainer disc and said locking nut for preventing said locking nut from being rotated by said tubular propeller housing.

2. The propeller assembly according to claim 1, wherein said stops include a number equals to that of said ears, a distance between any two adjacent stops is greater than a distance between any two adjacent ears for preventing said stops from moving beyond said ears and for preventing said tubular propeller housing from being disengaged from said retainer disc.

3. A propeller assembly for mounting on a rotatable propeller shaft of a watercraft, comprising:

a central hub mounted on the propeller shaft for rotational movement therewith, the central hub defining a generally cylindrical outer surface having a plurality of circumferentially spaced, axially extending keys therealong, each key having a first, narrow outer end and a second, wider inner end;

a generally tubular, propeller housing slidable onto the central hub for rotational movement with the propeller shaft the propeller housing includes an inner surface having a plurality of circumferentially spaced pairs of axially extending lobes therealong, each pair of lobes defining a corresponding keyway for receiving a corresponding key along the central hub; and a locking assembly mountable on the propeller shaft, the locking assembly preventing removal of the propeller housing from the central hub.

4. The propeller assembly of claim 3 wherein the propeller housing includes an inner surface having a plurality of stop elements extending toward the interior thereof, one or more of the stop elements engaging the locking assembly to prevent removal of the propeller housing from the central hub.

5. The propeller housing of claim 4 wherein each stop element includes an outer end flush with the first, wide end of each keyway.

6. The propeller assembly of claim 4 wherein the locking assembly includes a retainer disc having a plurality of circumferentially spaced ears for engaging one or more of the stop elements for preventing the propeller housing from sliding off the central hub.

7. The propeller assembly of claim 6 wherein the locking assembly further includes a locking nut mountable on the propeller shaft for retaining the retainer disc on the propeller shaft.

8. The propeller assembly of claim 7 wherein the locking assembly further includes a washer disposed between the retainer disc and the locking nut for preventing the locking nut from being rotated by the propeller housing.

9. The propeller assembly of claim 3 wherein each keyway in the propeller housing includes a first, wide end and a second, narrow end such that the wide end of each keyway receives the narrow end of a corresponding key of the central hub as the propeller housing is axially slid onto the central hub.

10. The propeller assembly of claim 3 where the propeller housing includes an outer surface and a plurality of circumferentially spaced propeller blades extending therefrom.

11. A propeller assembly for mounting on a rotatable propeller shaft of a watercraft, comprising:

a central hub mounted on the propeller shaft for rotational movement therewith, the central hub including an outer surface having a plurality of circumferentially spaced, axially extending keys therealong, each key having a first, narrow outer end and a second, wide inner end;

a generally tubular, propeller housing slidable onto the central hub for rotational movement with the propeller shaft, the propeller housing including an inner surface having a plurality of circumferentially spaced pairs of axially extending lobes therealong, each pair of lobes defining a corresponding keyway for receiving a corresponding key along the central hub; and a retainer disc for preventing the propeller housing from sliding off the central hub.

12. The propeller assembly of claim 11 further comprising a locking nut mountable on the propeller shaft for retaining the retainer disc on the propeller shaft.

13. The propeller assembly of claim 12 further comprising a washer disposed between the retainer disc and the locking nut for preventing the locking nut from being rotated by the propeller housing.

14. The propeller assembly of claim 13 wherein each keyway in the propeller housing includes a first, wide end and a second, narrow end such that the wide end of each keyway receives the narrow end of a corresponding key of the central hub as the propeller housing is axially slid onto the central hub.

15. The propeller assembly of claim 11 wherein the propeller housing includes an inner surface having a plurality of stop elements extending toward the interior thereof.

16. The propeller assembly of claim 15 wherein the retainer disc includes a plurality of circumferentially spaced ears extending therefrom for engaging one or more of the stop elements and preventing removal of the propeller housing from the central hub.

* * * * *